United States Patent [19]

Bockmon, Jr.

[11] 3,938,808

[45] Feb. 17, 1976

[54] GAME APPARATUS INCLUDING BOARD AND PIECES

[75] Inventor: William E. Bockmon, Jr., Louisville, Ky.

[73] Assignee: Gamut Games, Inc., Shepherdsville, Ky.

[22] Filed: Jan. 30, 1975

[21] Appl. No.: 545,665

[52] U.S. Cl...... 273/131 BA; 273/131 K; 273/137 R

[51] Int. Cl.[2]..... A63F 3/00

[58] Field of Search..... 273/131

[56] References Cited

UNITED STATES PATENTS

| | | | |
|---|---|---|---|
| 3,455,555 | 7/1969 | DeBono | 273/131 K |
| 3,603,591 | 9/1971 | Shoptaugh | 273/131 AB |
| 3,799,547 | 3/1974 | Hills | 273/131 B |

*Primary Examiner*—Delbert B. Lowe

*Attorney, Agent, or Firm*—Dowell & Dowell

[57] ABSTRACT

A game, including gameboard and pieces, wherein the board comprises a number of similar discrete areas each capable of receiving a piece during a move by one of several participating players, the areas and pieces being symetrically disposed as viewed by the players at the start of the game. The pieces include for each player uniquely colored pawns and another similarly-colored larger piece referred to herein as a knight, the latter occupying multiple contiguous areas at the same time. The players have sequential "moves", each complete move of a player requiring that he first move his knight to a location including at least one newly occupied area and that he thereafter move one of his pawns to a different new area. These pieces can be moved anywhere on the board so long as the areas to which they move are not already occupied. The game ends for a losing player when he is no longer able to move his knight so as to occupy at least one new area.

5 Claims, 5 Drawing Figures

GAME APPARATUS INCLUDING BOARD AND PIECES

This invention relates to a new game including a gameboard and pieces sufficient for several players, the game being played with more than half of the discrete areas on the gameboard occupied by pieces and at least one of the pieces of each player being a larger piece shaped to occupy multiple contiguous areas, whereby with all of the pieces on the board it is possible for them to be arranged at the start of the game so that the larger pieces can be moved about rather freely, but so that at the finish of the game the losing player finds it impossible to move his larger piece to occupy a new combination of areas so that his larger piece or knight is trapped in its present location.

It is the purpose of this invention to provide a game having only a few simple rules easily learned by children and having simple pieces comprising pawns and larger pieces called knights, but having the capability of intriguing more competitive intellects by providing the opportunity for complex move-planning strategy resulting partly from the fact that each player can find his own pawns are as much a hazzard to the next move of his knight as are the pieces which are not under his own control.

The object of the game is to have plural players move their pieces in sequential turns in such a way as to trap an opponent and leave him without the capability of making the moves required of him during his next turn. Each complete turn requires that a player first move his knight to any unoccupied pattern of areas on the board which it will fit and which includes at least one newly occupied area, and then move one of his pawns to a new area not now occupied. The knight may be flipped over, turned around and/or picked up and set down again in another zone of the board. The sequence of such turns proceeds until a player is unable to move his knight to an area including at least one new area of its occupancy.

DESCRIPTION OF DRAWING

Referring to FIGS. 1, 2, and 3, these views show a practical embodiment of the game designed for two-player participation. The game includes a gameboard 10 having a large number of discrete areas 12 arranged in rows and columns which can be occupied by game pieces including pawns 14 and knights 16, FIGS. 2 and 3. Each player is provided with his own color-distinguished set of pieces including a knight and plural pawns. In the embodiment illustrated, which corresponds with the one being currently manufactured, the areas 12 are provided with sockets 13 shaped to receive the pawns which can be plugged thereinto for greater stability when the game is played for instance in a moving vehicle. In this embodiment, the central area 11 is never occupied by any piece. It should be noted that all of the pieces remain on the board 10 at all times and that they occupy a total of sixteen discrete areas, whereas the board has a total of twenty-four occupiable areas. Thus two-thirds of the areas are always occupied in this embodiment. Each player has enough pawns to occupy at least as many areas as are occupied by his own knight.

FIG. 4 shows a suitable placement of pieces to "START" the game, the placement being symmetrical as viewed by both players, one manipulating the unshaded pieces 14 and 16 and the other manipulating the shaded pieces 14' and 16'. Note that in FIG. 4 the placement of the pawns 14 and 14' is such that there is plenty of room on the board to freely move both knights 16 and 16' according to the rule that after each move a knight must occupy areas including at least one previously vacant area. However, as the game progresses, the pawns 14 and 14' become a hazard to both knights.

FIG. 5 shows a situation which can be the end of the game for the player manipulating the unshaded knight 16. If the other player has just completed his move he is the winner because the unshaded knight 16 can not now be moved so as to occupy a new area. Conversely, if the player having the unshaded pieces had just completed his move, the game would not be over yet because the player manipulating the shaded knight 16' can still move it another time. Incidentally, the unshaded knight, under the latter suppositions, would just have participated in a very poorly planned move, since the player has left no place to move the knight 16 on his next turn.

Figure 1:
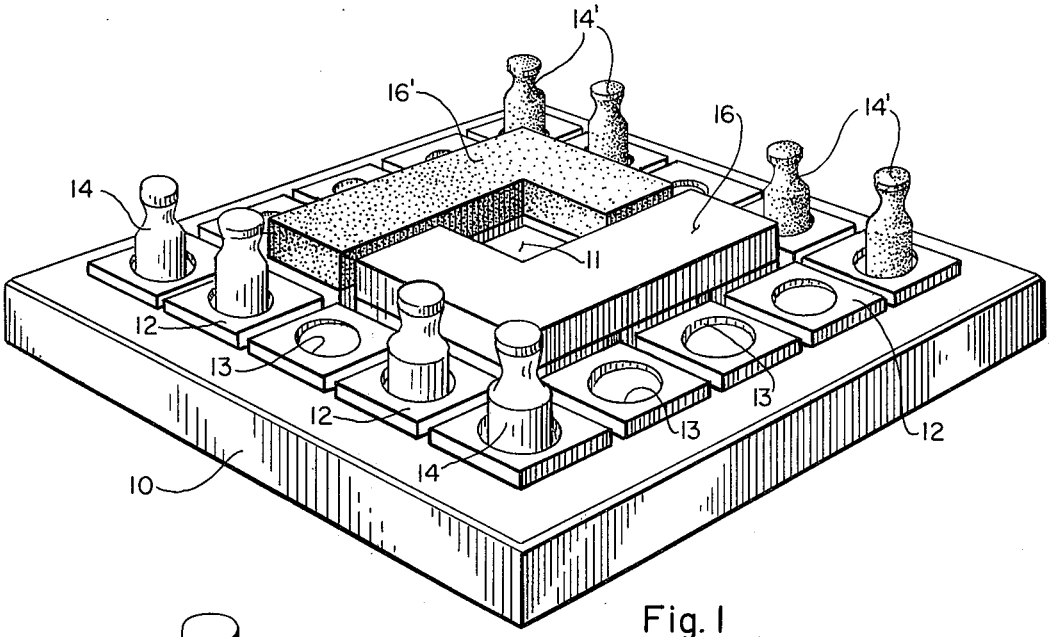
FIG. 1 is a perspective view of a gameboard and pieces illustrative of this invention.
Figure 2:
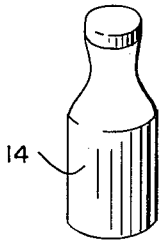
FIG. 2 is a perspective view of a pawn piece.
Figure 3:
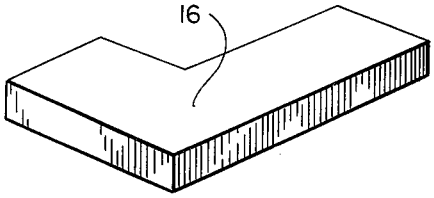
FIG. 3 is a perspective view of a knight piece.
Figure 4:
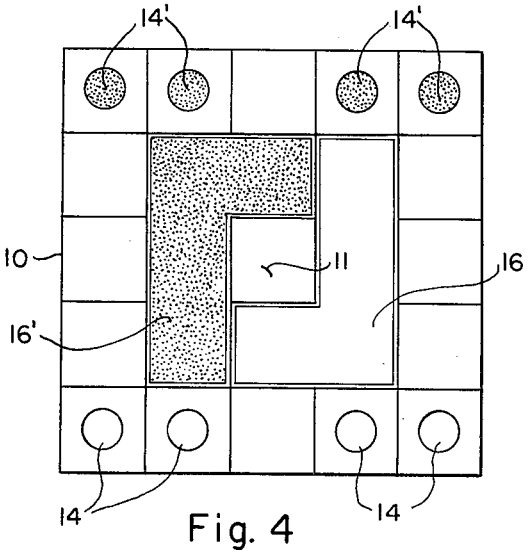
FIG. 4 is a schematic plan view showing an exemplary starting placement of the pieces on the board for two-player participation.
Figure 5:
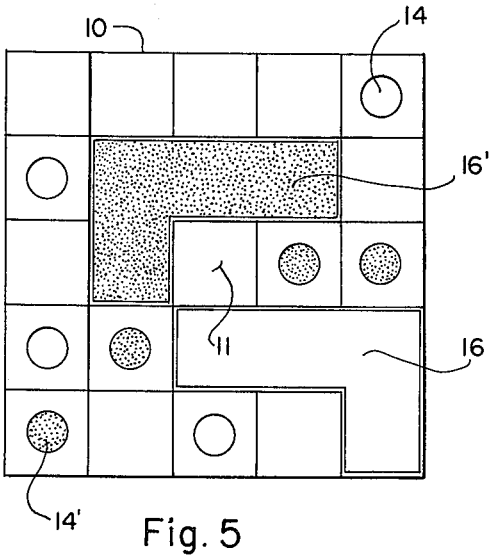
FIG. 5 is a schematic plan view of one of many possible endings of the game in which the player having the shaded pieces has completed his turn and has trapped the player having the unshaded pieces, since the unshaded knight can not be further moved as required in the rules.

Although the illustrative embodiment of FIG. 1 is suitable for two-player participation, it is contemplated that the board can be altered and enlarged to accomodate more than two players using additional sets of pawns and knights having different distinguishing colors. With more than two players, the losing players would be eliminated one at a time and would stop playing although their pieces would remain on the board frozen in their final-move positions.

This invention is not to be limited to the exact forms shown in the drawings, for obviously changes can be made therein within the scope of the following claims.

I claim:

1. A game for plural participating players including a gameboard having multiple discrete areas disposed in rows and columns, each row and each column having an odd number of areas so that there is on the board one central discrete area, the areas being symmetrically disposed as viewed by each of the players; and differently colored sets of pieces for the different players, each set including a fixed number of pawns each occupying one discrete area and including a knight shaped to occupy at least several contiguous areas, all of the areas except the central area being capable of occupation by a piece and the discrete areas of the gameboard which are occupied when all of the pieces are positioned thereon being greater than half the total number of discrete areas on the gameboard but never including the central area.

2. A game as set forth in claim 1, wherein said pieces occupy about two-thirds of the discrete areas of the gameboard.

3. A game as set forth in claim 1, wherein the gameboard is rectangular wherein said knights are L-shaped and each occupies at least four discrete areas, and wherein the number of pawns in the participating sets are sufficient that the total number of areas occupied by the pawns is at least equal to the total number of areas occupied by the knights.

4. A game as set forth in claim 1, wherein the gameboard has mutually crossing rows of discrete areas, and wherein said knights are shaped such that they occupy contiguous areas in different rows and the numbers of areas occupied by each knight in these rows are different.

5. A game for two participating players including a rectangular gameboard having five rows and five columns of discrete areas disposed symmetrically as viewed by each of the players; and differently colored sets of pieces for the different players, each set including four pawns each occupying one discrete area and including an L-shaped knight shaped to occupy four contiguous areas, the total number of discrete areas of the gameboard occupied when all of the pieces are positioned thereon being greater than half the total number of discrete areas on the gameboard, said discrete areas having sockets extending into the board into which the pawns are shaped to fit and the center discrete area of the board having no socket and never being occupied by a piece.

* * * * *